US005476060A

United States Patent [19]

Kobayashi

[11] Patent Number: 5,476,060

[45] Date of Patent: Dec. 19, 1995

[54] CABIN FOR DOCKING WATERCRAFT

[75] Inventor: Noboru Kobayashi, Iwata, Japan

[73] Assignee: Yamaha Hatsudoki Kabushiki Kaisha, Iwata, Japan

[21] Appl. No.: 212,255

[22] Filed: Mar. 14, 1994

[30] Foreign Application Priority Data

Mar. 12, 1993 [JP] Japan ..... 5-052587

[51] Int. Cl.[6] ..... B63B 21/56

[52] U.S. Cl. ..... 114/248; 114/270

[58] Field of Search ..... 114/248, 259, 114/258, 260, 230, 263, 270; 440/38

[56] References Cited

U.S. PATENT DOCUMENTS

| | | | |
|---|---|---|---|
| 3,347,201 | 10/1967 | Szabo | 114/259 |
| 3,815,541 | 6/1974 | Hansen | 114/259 |
| 3,837,315 | 9/1974 | Giblon | 114/248 |
| 3,858,541 | 1/1975 | Metcalf, Jr. et al. | 114/248 |

FOREIGN PATENT DOCUMENTS

| | | | |
|---|---|---|---|
| 63-119198 | 8/1988 | Japan . | |
| 0465996 | 1/1992 | Japan | 114/248 |
| 2046689 | 4/1980 | United Kingdom . | |

OTHER PUBLICATIONS

Patent Abstract of Japan, vol. 14, No. 174, (M–959) 5 Apr. 1990; & JP A 2 28 088 (Yanmar Diesel Ltd) 30 Jan. 1990; Translations of Japanese Apps. 63–119198 & 2–28088; publication: "The Party Shark"—The Ultimate Jet Ski Accessory.

*Primary Examiner*—Edwin L. Swinehart
*Attorney, Agent, or Firm*—Knobbe, Martens, Olson & Bear

[57] ABSTRACT

A number of embodiments of docking watercraft, each embodying at least one cabin adapted to contain at least one bunk for accommodating a lying passenger. The cabin is disposed relative to the berthing area so that an operator on the smaller watercraft in the berthing area can operate the combined watercraft without his view being substantially obstructed by the cabin. Both forward and side position cabins are disclosed, and in some embodiments, the berthing area extends beneath a seat in a forward passenger's compartment so as to reduce the overall length of the watercraft.

23 Claims, 10 Drawing Sheets

CABIN FOR DOCKING WATERCRAFT

BACKGROUND OF THE INVENTION

This invention relates to an improved docking-type watercraft and more particularly to a cabin and passenger's compartment area for such a watercraft.

As is well known, there is a very popular type of watercraft known as a "personal watercraft" which is designed to be operated primarily by a single rider seated or standing behind the control area and which is powered by a jet propulsion unit. Some of these watercraft make provision for seating an additional passenger behind the rider with the passenger being seated in straddle, tandem fashion. This type of watercraft is quite popular.

As is noted, however, in the copending application entitled watercraft, Ser. No. 07/722,599, filed Jun. 27, 1991 in the name of the inventor hereof and Toshiyuki Hattori and in Toshihiro Hattori's application of the same title, Ser. No. 07/857,624, U.S. Pat. No. 5,255,625, filed Mar. 25, 1992, which applications are assigned to the assignee hereof, there is a desire to provide greater versatility for such watercraft including the desire to accommodate a greater number of passengers and/or permit cruising for greater distances. This goal is accomplished, without sacrificing the maneuverability of the speed of the powered personal watercraft by providing a larger unpowered hull having a docking area into which the personal watercraft may be positioned and which is constructed so as to permit the personal watercraft propulsion unit to power not only the personal watercraft but also the larger unpowered hull. The arrangements shown in those copending applications significantly increase the versatility of the personal watercraft without in any way adversely effecting its performance or the ability to use it alone.

The type of watercraft shown in the copending applications is frequently referred to as a "docking type watercraft" and this invention relates to an improvement of that type of watercraft. Specifically, the arrangement shown in the copending applications referred to have a number of advantages. However, there is a desire to provide an enclosed compartment in which one or more berths may be formed so that passengers can be accommodated in a protected fashion. The cabins also should provide weather protection for the occupants. In addition, the cabin disposition should be such that it will not interfere with the operation of the watercraft when propelled by the personal watercraft contained within the berthing area.

It is, therefore, a principal object of this invention or provide an improved type of watercraft.

It is a further object of this invention to provide a docking type of watercraft wherein the main hull provides a cabin area designed to accommodate at least one berth and wherein the docking watercraft may be operated from the small watercraft contained within the berthing area.

In the docking watercraft of the type disclosed in the copending applications, several embodiments are shown wherein a seating area is provided transversely across the front of the berthing area. This permits the maximum number of passengers to be accommodated in a seated fashion. However, if the seating position is forward of the berthing area, then the unpowered hull can have a greater than desired length.

It is, therefore, a still further object of this invention to provide an improved docking type of watercraft that will accommodate a seat forwardly of the berthing area and wherein the docked watercraft may be positioned at least in part beneath the seat so as to reduce the overall length of the combined watercraft.

SUMMARY OF THE INVENTION

A first feature of this invention is adapted to be embodied in a watercraft comprised of a main hull which is devoid of any propulsion device and which defines a passenger's area adapted to accommodate a plurality of passengers and a berthing area adapted to accommodate a smaller watercraft hull having a powering internal combustion engine and a propulsion device driven by the engine and in which the engine and propulsion device are capable of propelling the main hull. The smaller watercraft hull has a control for the watercraft and a passenger's area for accommodating a rider in position to control the smaller watercraft from the control. Means define a cabin at least in part in the main hull passenger's area which contains at least one bunk to accommodate a lying person. The cabin is positioned and configured so that a rider on the smaller watercraft within the berthing area can operate the controls without his forward visibility being obscured significantly by the cabin.

Another feature of the invention is also adapted to be embodied in a watercraft comprised of a main hull devoid of any propulsion device and defining a passenger's area adapted to accommodate a plurality of passengers and a berthing area that is adapted to accommodate a smaller watercraft hull having a powering internal combustion engine and a propulsion device driven by the engine and in which the engine and propulsion device are capable of propelling the main hull. At least one seat is disposed in the passenger's area generally forwardly of the berthing area. However, the berthing area has a portion that extends beneath the seat and which is configured so as to accommodate the bow of the smaller watercraft.

DETAILED DESCRIPTION OF THE PREFERRED EMBODIMENTS OF THE INVENTION

Figure 4:
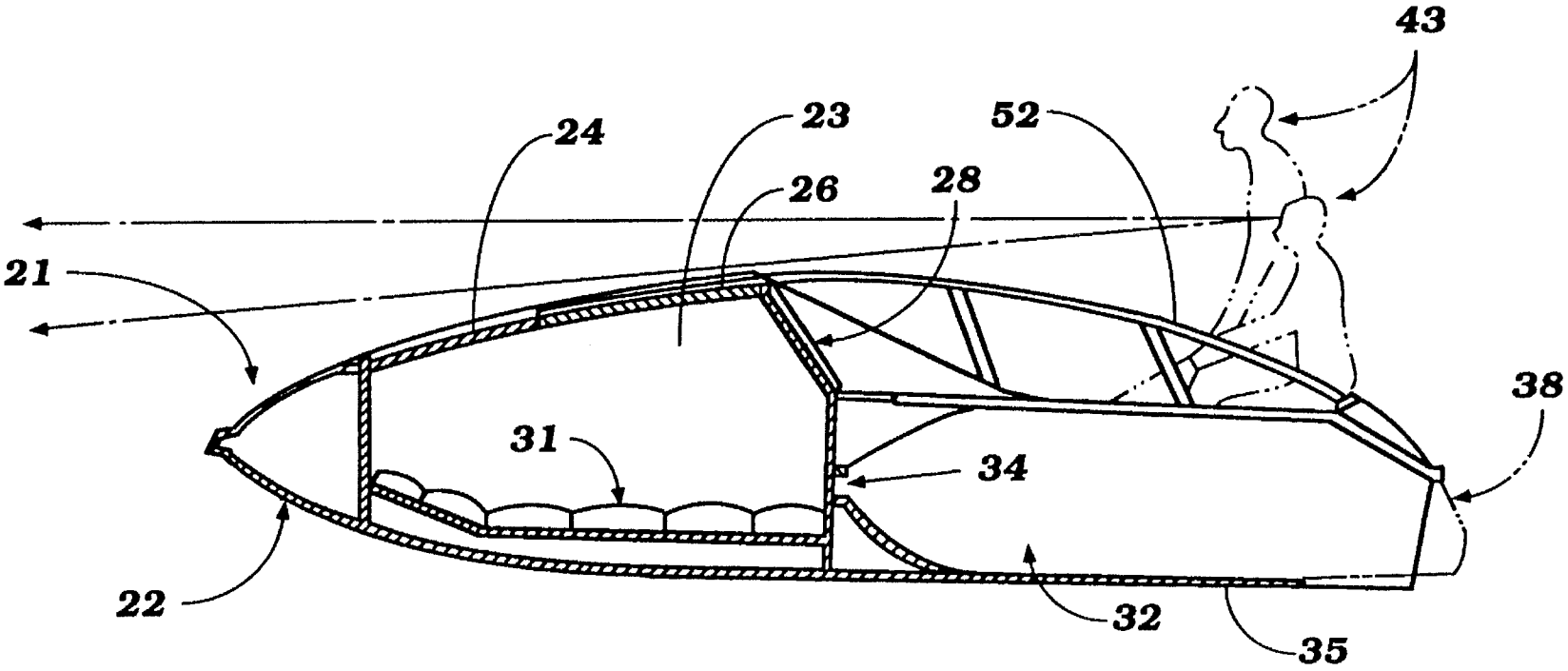
FIG. 4 is a view, in part similar to FIG. 2, but showing a portion of the cabin in cross section and the personal watercraft and passengers in phantom.
Figure 5:
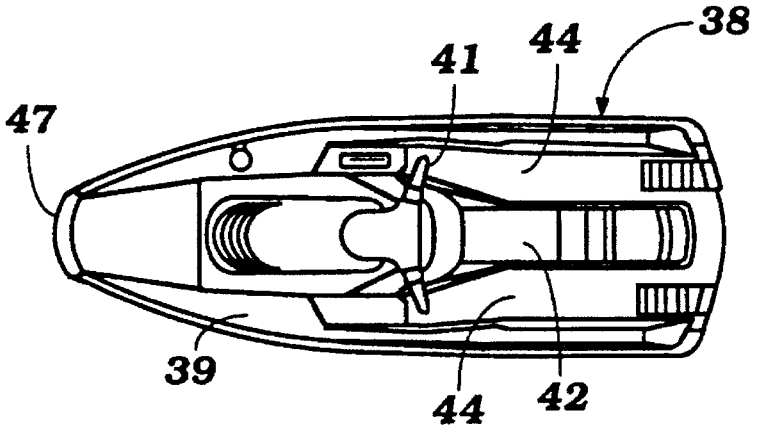
FIG. 5 is a top plan view of the personal watercraft.
Figure 6:
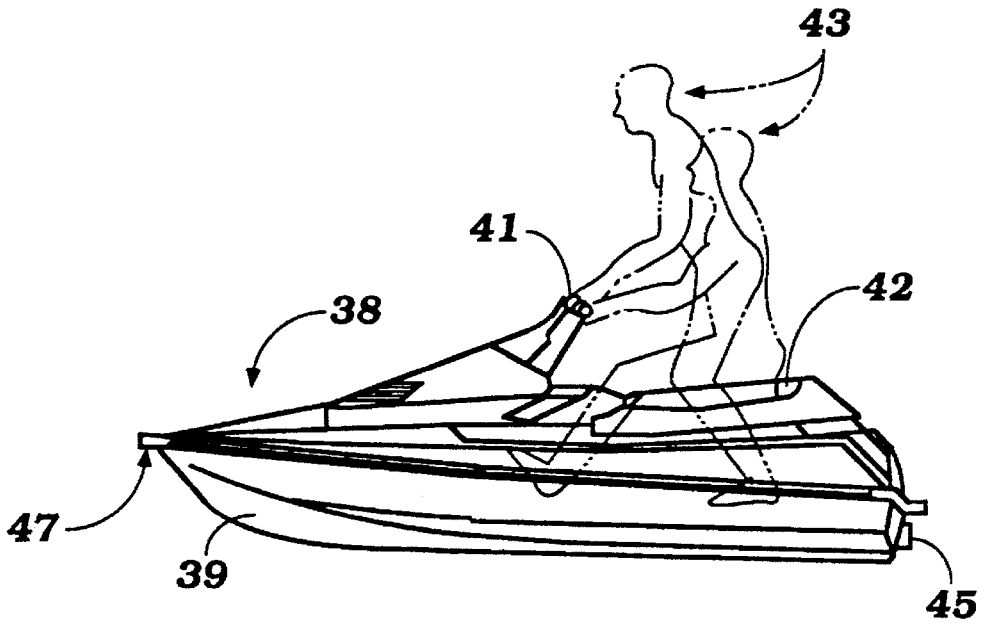
FIG. 6 is a side elevational view of the personal watercraft showing the two riding positions for the operator.

Referring first to the embodiment of FIGS. 1–6, although it should be understood that FIGS. 5 and 6 show a conventional personal type of watercraft, a combined watercraft constructed in accordance with this embodiment is identified generally by the reference numeral 21 and includes a larger unpowered main hull, indicated generally by the reference numeral 22. The main hull 22 is formed in any suitable manner and from any suitable material such as a molded fiberglass reinforced resin or the like and which defines a passenger's area comprised in part of a forwardly positioned cabin 23 which is enclosed at its upper side by a deck 24 and in which a pair of side port holes 25 are formed. The cabin 23 is accessible through a hatch cover comprised of a pivotally supported hatch piece 26 that is pivotally connected to the deck 24 by a pair of hinges 27 and a sliding cover 28 that is slidably supported in a pair of channels 29 formed on opposite sides of the rear portion of the deck 24.

A pair of bunks 31 are disposed on opposite sides of the cabin 23 and these bunks 31 may fold up into a pair of facing seats, if desired. FIG. 4 is a cross-sectional view which could be taken along either side of the cabin 23 and shows how the bunks, in their folded down condition, would appear.

Rearwardly of the cabin 23, the hull 22 is provided with a berthing area 32 which is defined by a pair of facing side walls 33, a front recess 34 and a lower wall 35. The lower wall 35 is provided with a cutout 36, for a reason which will become apparent. It should be noted that the berthing area 32 is open generally through the rear or transom 37 of the unpowered main hull 22 so that a smaller personal watercraft, indicated generally by the reference numeral 38 may be driven into the berthing area 32.

The smaller personal watercraft 38 is shown in more detail in FIGS. 5 and 6. This watercraft 38 has a hull assembly 39 with a centrally raised mast portion 41 that provides steering and speed controls for the propulsion unit, to be described, of the smaller watercraft 38. A seat 42 is provided to the rear of the mast 41 and is adapted to accommodate a single rider, shown in phantom at 43 in either a standing or seated position. A pair of foot areas 44 are disposed on opposite sides of the seat 42 so as to accommodate the rider 43 in either of these positions and wherein the rider can operate the controls on the mast 41.

The watercraft 38 has an internal combustion engine (not shown) which drives a jet propulsion unit having a downwardly facing water inlet opening and a rearwardly facing discharge nozzle 45. The discharge nozzle 45 may be pivoted about a vertically extending steering axis for steering of the personal watercraft 38 in a manner well known in this art. Actually, the details of the smaller watercraft 38 may be considered to be of any conventional type inasmuch as the berthing area 32 is sized so as to accommodate any well known types of personal watercraft.

A bumper 47 is provided at the forward portion of the bow of the smaller watercraft hull 39 and this bumper 47 is configured along with the recess 34 so that when the smaller watercraft 38 is in the berthing area 32 it will be snugly held in position. The opening 36 in the lower wall 35 of the berthing area is sized and configured so as to cooperate with the downwardly facing water inlet of the jet propulsion unit of the personal watercraft 38 so that water may be freely drawn therethrough so as to propel not only the smaller personal watercraft 38 but also the main hull 22 and combined watercraft 21 when received in the berthing area. A hold-down strap arrangement (not shown) may be provided so as to hold the hull 39 in engagement with the lower berthing area surface 35 as disclosed in the aforenoted copending applications.

It will be noted from FIG. 4 that the height of the cabins 23 is such that the operator 43 may have a full forward line of visibility regardless of whether he is in a seated or standing position. Of course, his view will be less obstructed when standing and the operator 43 may be in the standing position when docking. When operating normally at open sea, however, the watercraft 21 will be operated primarily with the operator 43 in a seated position.

The passenger's area for the unpowered hull 22, in addition to the cabin 23, includes a pair of side areas in which seats 48 are positioned so as to accommodate seated riders. These seats 48 are juxtaposed to-the mast 41 so that the combined watercraft can also be operated by a rider seated in either of the seats 48 and controlling the controls on the mast 41 therefrom. Forwardly of the seats 48 and specifically of foot areas 49 positioned at the front thereof, there are provided a pair of storage compartments which are accessible through hatch covers 51.

Figure 1:
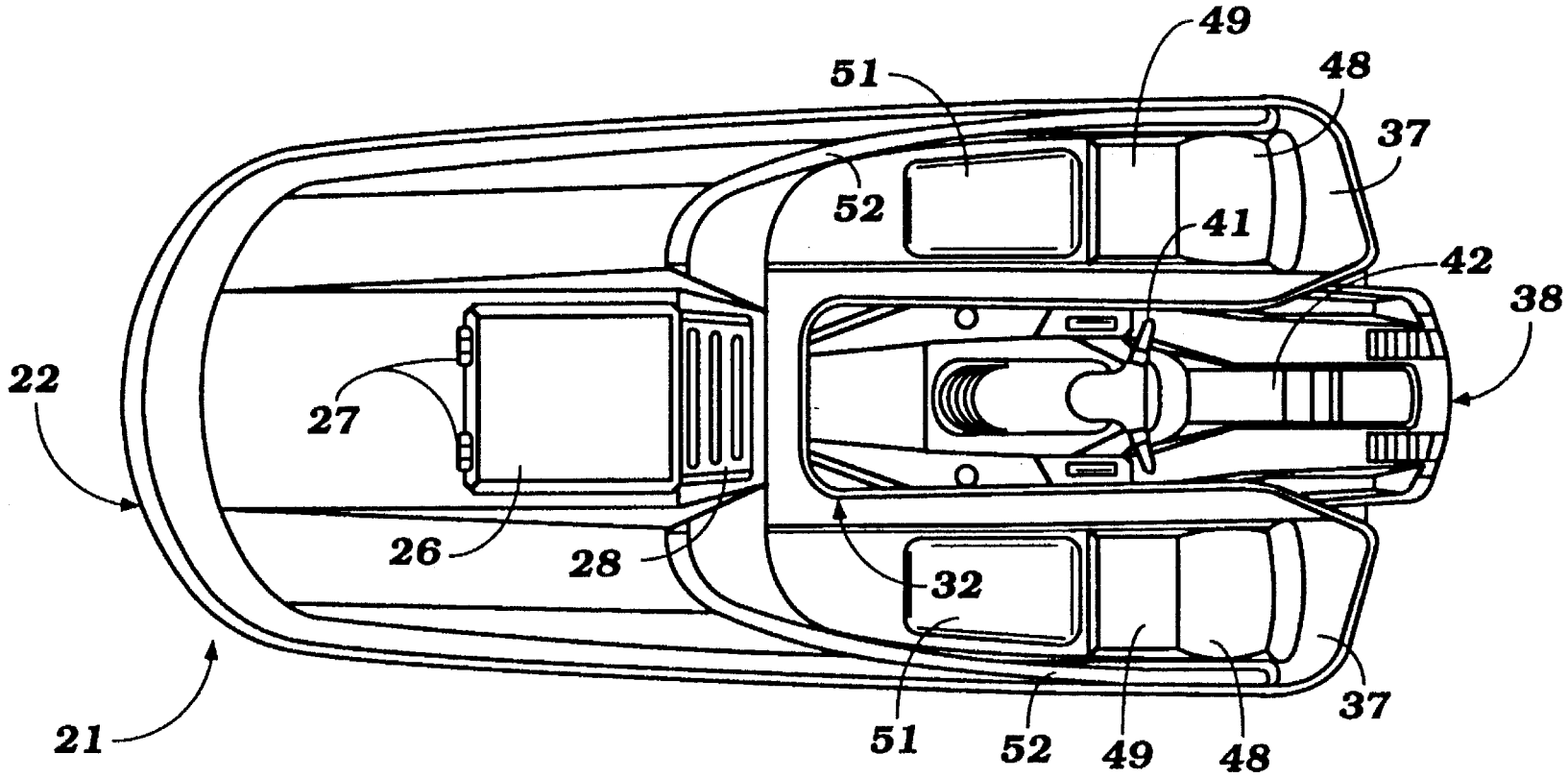
FIG. 1 is a top plan view of a docking watercraft constructed in accordance with a first embodiment of the invention, with the personal watercraft in the berthing area.
Figure 2:
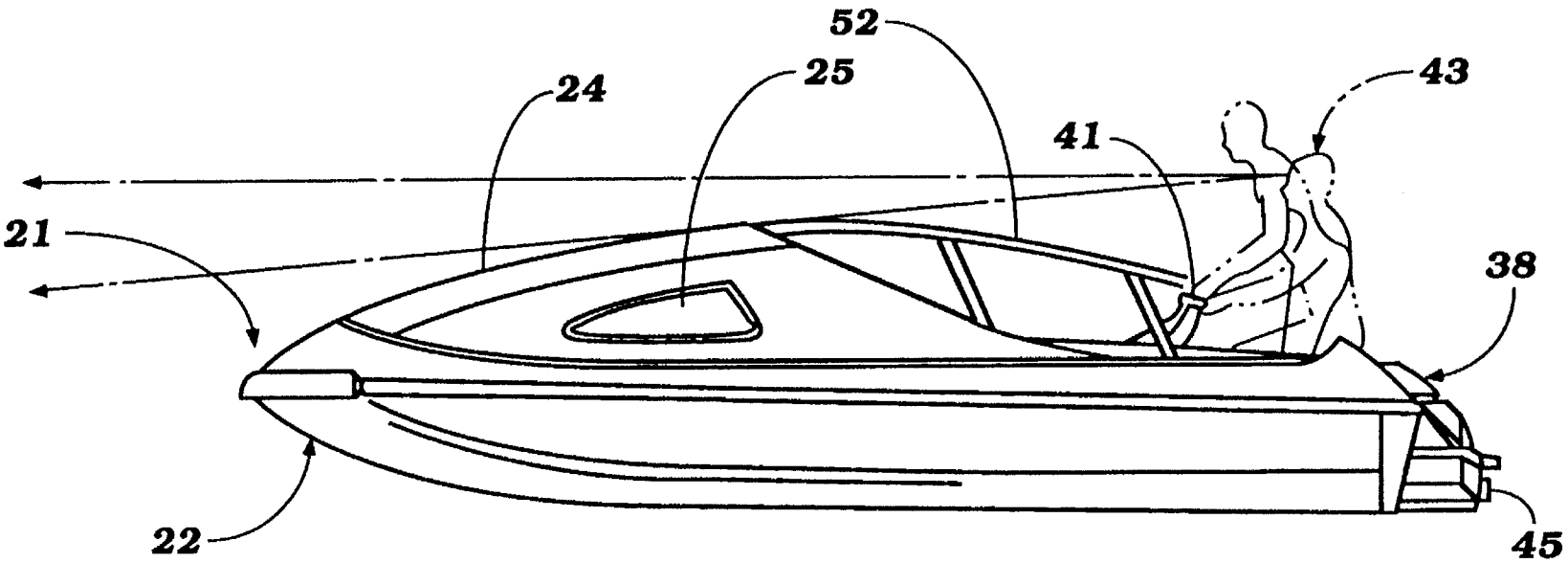
FIG. 2 is a side elevational view, with a portion broken away, showing how the rider/operator can operate the combined watercraft from either a sitting or a standing position in the personal watercraft.
Figure 3:
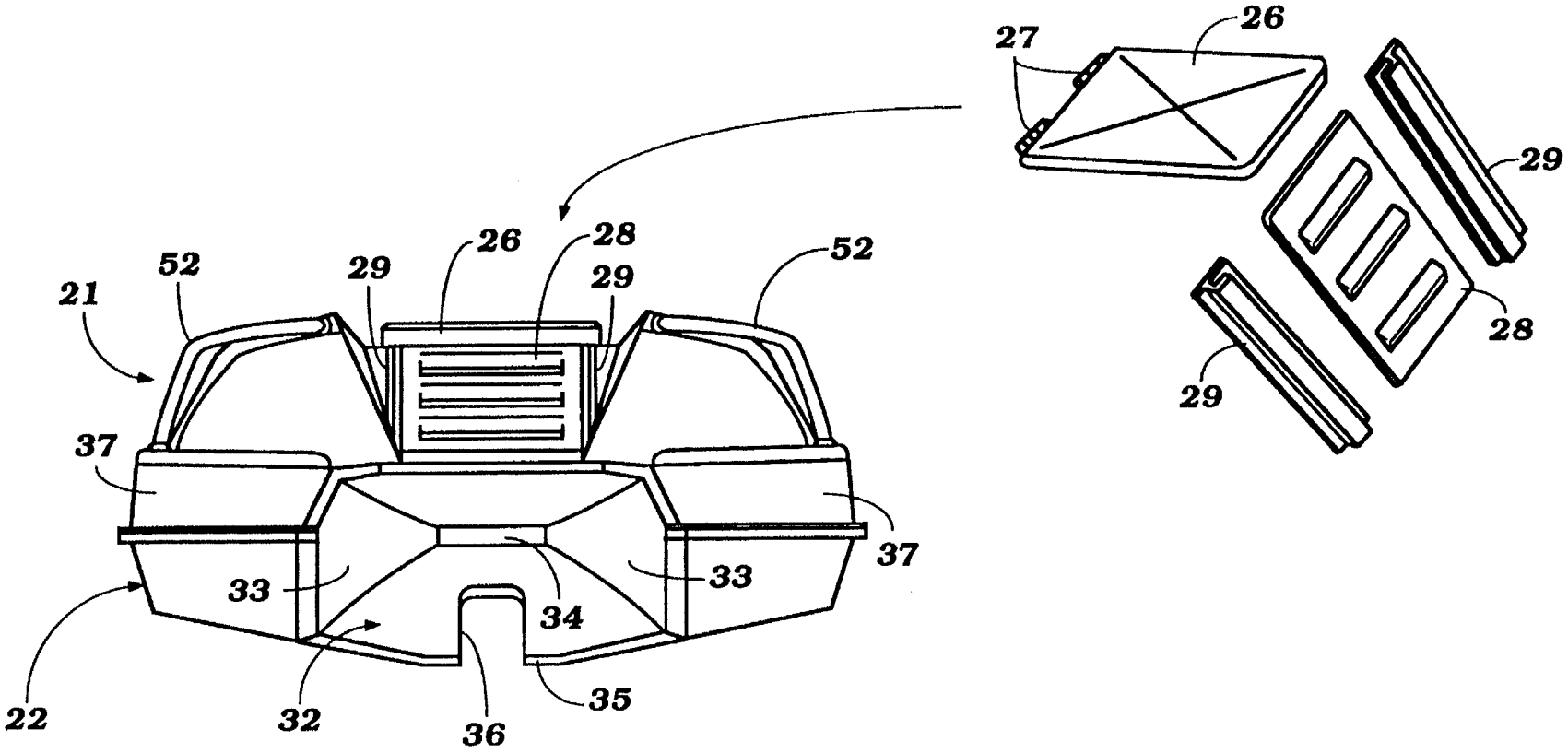
FIG. 3 is rear elevational view, with the access hatch for the cabin shown in an exploded condition.

This rearward passenger's area is encompassed by a guardrail 52 which is broken away in FIG. 2 so as to show how the operator can control the combined watercraft 21 whether seated or standing.

Figure 7:
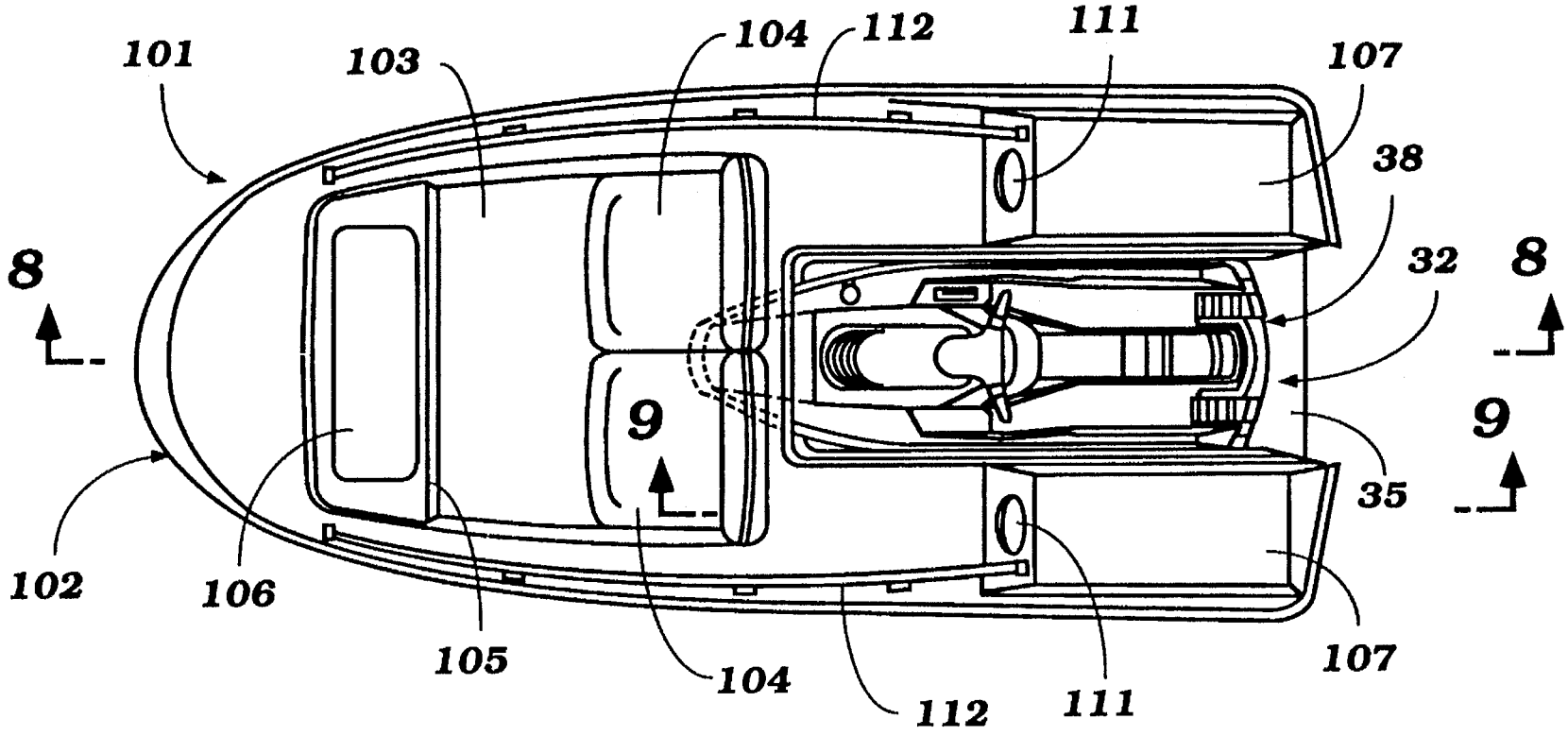
FIG. 7 is a top plan view, in part similar to FIG. 1, and shows a second embodiment of the invention.
Figure 8:
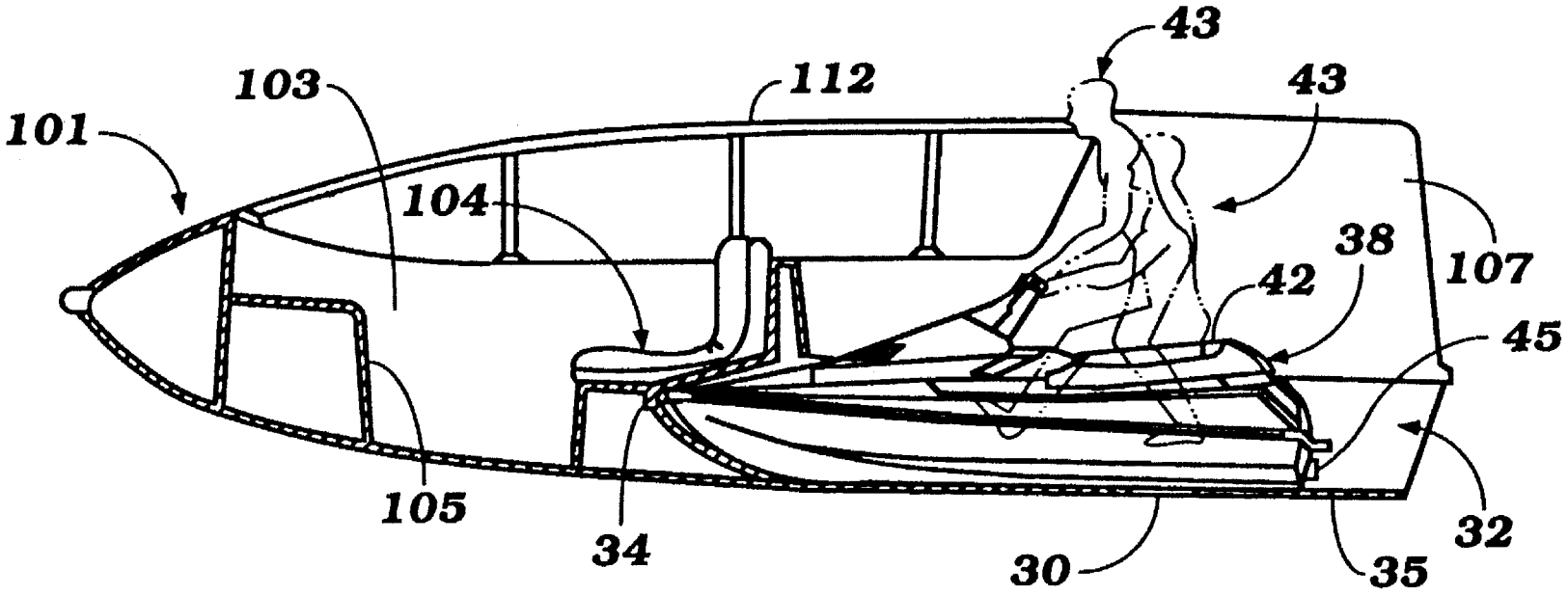
FIG. 8 is a cross-sectional view taken along the line 8—8 of FIG. 7.
Figure 9:
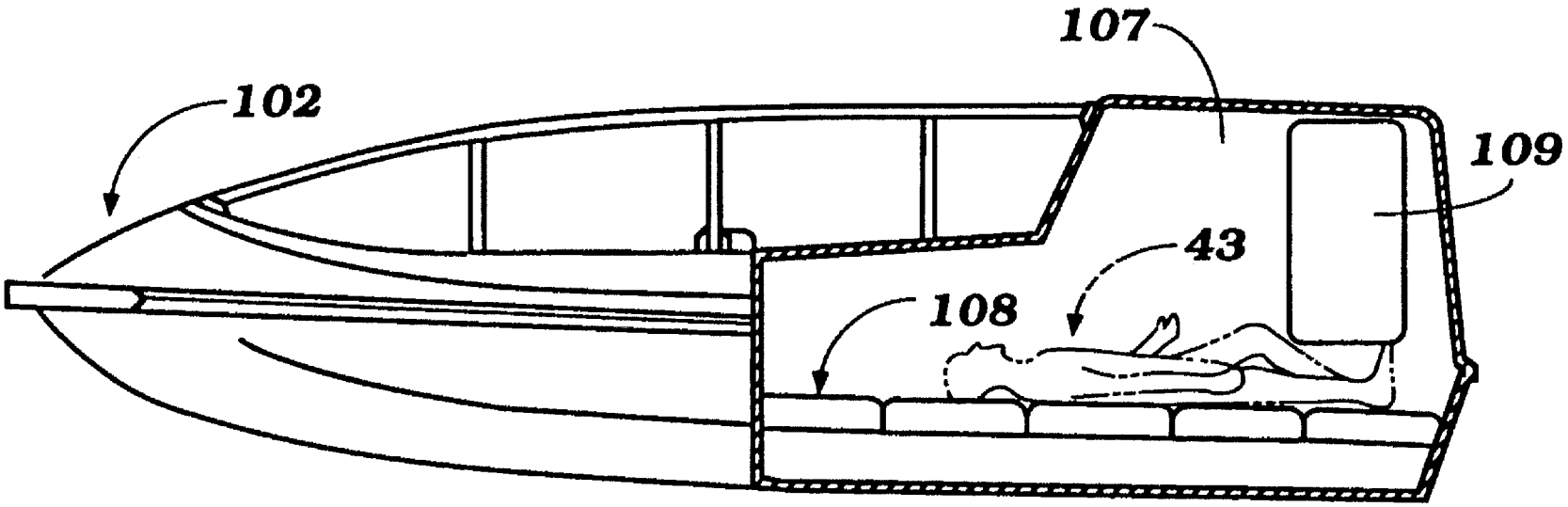
FIG. 9 is a cross-sectional view taken along the line 9—9 of FIG. 7.
Figure 10:
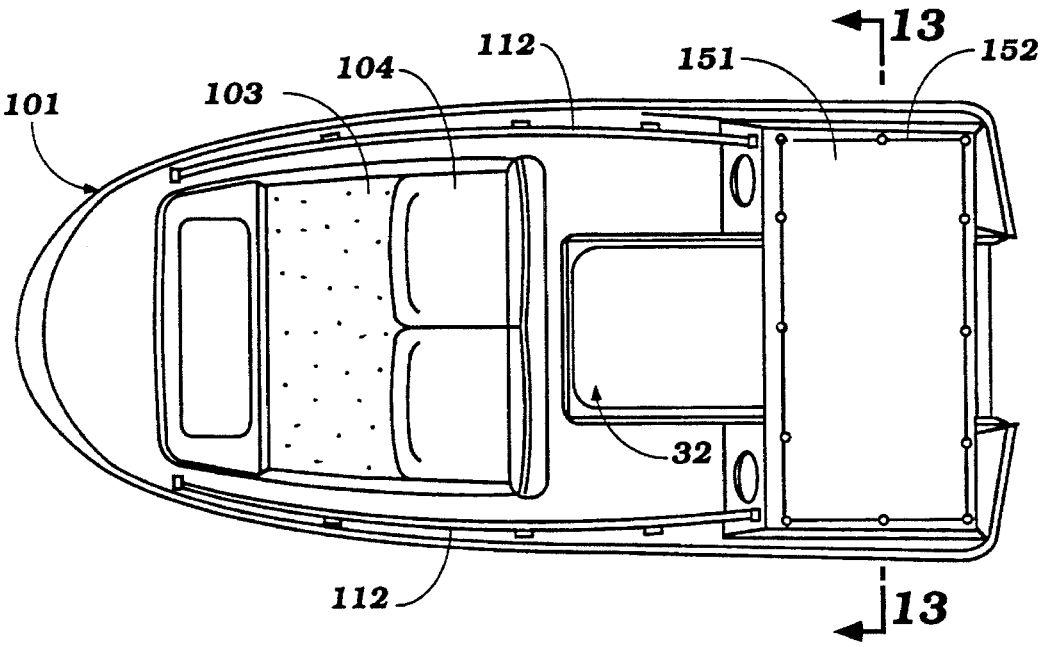
FIG. 10 is a top plan view, in part similar to FIGS. 1 and 7, and shows a further embodiment of the invention.
Figure 11:
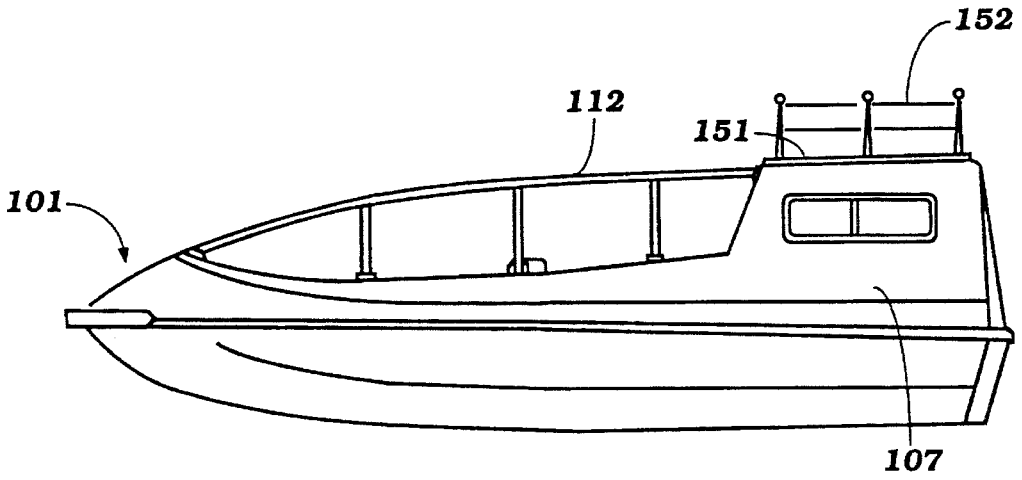
FIG. 11 is a side elevational view of this embodiment.
Figure 12:
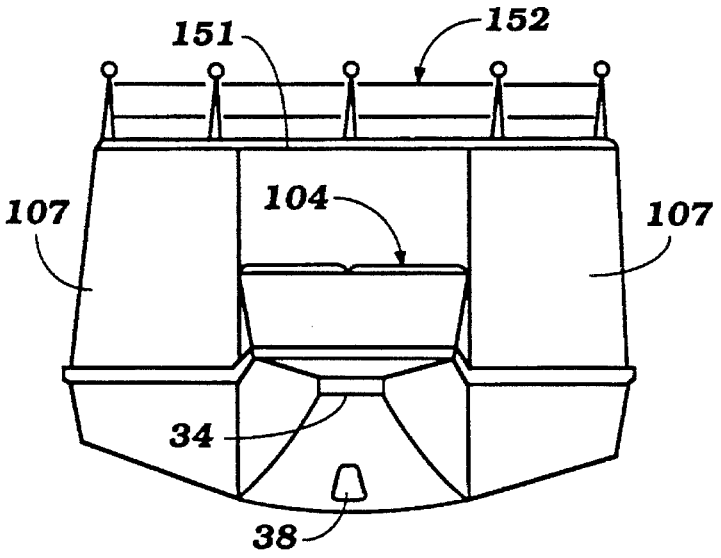
FIG. 12 is a rear elevational view of this embodiment.
Figure 13:
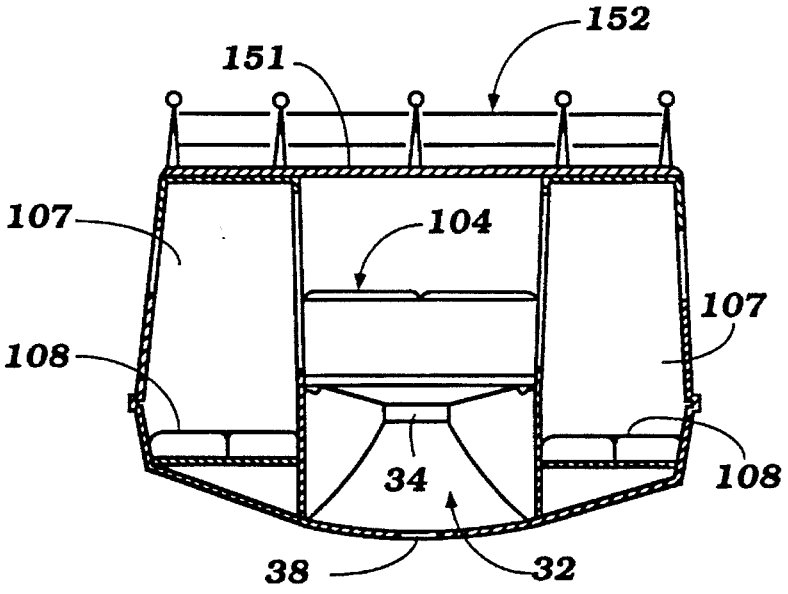
FIG. 13 is a cross-sectional view taken along the line 13—13 of FIG. 10.

A combined watercraft constructed in accordance with a second embodiment of the invention is shown in FIGS. 7–9 and is identified generally by the reference numeral 101. This combined watercraft 101 differs from the watercraft 21 in the previously described embodiment only in the configuration of the unpowered main hull 102. This differs from the main hull 22 of the previously described embodiment only in the layout and configuration of the passenger's area.

The berthing area, indicated in this embodiment also by the reference numeral 32 has the same general configuration as previously described although it interrelates with the passenger's area in a slightly different fashion for a reason to be noted. However, the general construction is the same including the opening 36 in the lower wall 35 of the berthing area so as to accommodate the water inlet opening of the jet propulsion unit of the personal or smaller watercraft 38.

In this embodiment, a passenger's area, indicated generally by the reference numeral 103 is positioned in part forwardly of the berthing area 32. However, there are a pair of rear seats 104 extending transversely across the rear of the passenger's area 103 and which are disposed above the nesting front portion 34 of the berthing area 32 so that the smaller watercraft 38, when received in the berthing area 32, actually extends in part beneath the front passenger's area 103 and specifically the seats 104. This permits a reduction in the overall length of the combined watercraft 102 without them adversely affecting the ability to carry passengers. At the front of the passenger's area 103 there is provided a storage compartment 105 that can be accessed through a hatch cover 106.

A pair of rear cabins 107 are disposed on opposite sides of the berthing area 32 and each contains a foldable bunk 108 in which a rider or passenger 43 may lie. A door 109 is disposed on the inner sides of each of the cabins 107 and permit entry from the berthing area 32. The bunks 108 may fold from a downward position wherein the rider may lie to an upper position wherein the riders may face forwardly. Port holes 111 are provided at the front of the cabins 107.

A rail 112 is disposed on opposite sides of the front passenger's compartment 103 and extends rearwardly to the cabins 107.

As may be seen in FIG. 8, the cabins 107 are disposed rearwardly on opposite sides of the small or personal watercraft seat 42 so as to not obstruct the forward vision of the rider 43 when either seated or standing. Also, the front passenger's compartment 103 is disposed low enough so that it will not obstruct the forward view of the operator 43.

FIGS. 10–13 show another embodiment of the invention which is basically the same as the embodiment of FIGS. 7–9 and, for that reason, components of this embodiment which are the same as those previously described have been identified by the same reference numerals. In the previously described embodiment, the cabins 107 were disposed on opposite sides of the berthing area 32, as is common with this embodiment. However, the area between the cabins was opened and hence there was no roof or cover over the berthing area 32. In this embodiment, a roof 151 extends across the tops of the cabins 107 and provides a partial enclosure for the berthing area 32 and specifically the area over the rear of the seat 42 of the smaller watercraft 38 when in position. A small railing 152 may be provided around the roof 151 so as to accommodate and protect a rider who wishes to sunbathe on the roof 151.

Although the roof 151 will provide some weather protection for the operator 43 of the smaller watercraft when in the berthing area, this operator still has an unobstructed forward view and thus the advantages of the previously described embodiments are retained herein.

It should be readily apparent from the foregoing description that the described embodiments provide a very effective docking type watercraft wherein a cabin or cabins are provided that can accommodate berths for sleeping passengers without obstructing the view of an operator operating the combined watercraft while seated on the personal watercraft in the berthing area. In addition, the embodiments of FIGS. 7–13 provide an arrangement wherein the berthing area extends in part beneath the forwardly positioned seat so as to provide a reduction in overall length without sacrificing rider's area.

Of course, the foregoing description is that of preferred embodiments of the invention and various changes and modifications may be made without departing from the spirit and scope of the invention, as defined by the appended claims.

I claim:

1. A watercraft comprised of a main hull devoid of any propulsion device and defining a passenger's area adapted to accommodate a plurality of passengers and a berthing area opening through a transom of said main hull and adapted to accommodate a smaller watercraft hull having a powering internal combustion engine and a propulsion device driven by said engine and in which said engine and propulsion device are capable of propelling said main hull, said smaller watercraft hull having a control for said smaller watercraft and a passenger's area in proximity to said control for control of said smaller watercraft by a passenger in said passenger's area, and means defining a cabin in said main hull in at least a portion of said passenger's area and containing at least one bunk to accommodate a lying passenger and a roof over said cabin, said being roof being related to said berthing area so that a rider on said smaller watercraft can operate said watercraft when said smaller watercraft is in said berthing area without his view over said cabin roof being substantially obstructed.

2. The watercraft as defined in claim 1, wherein the passenger's area of the smaller watercraft will accommodate the rider either in standing or seated fashion and operating the control in either fashion and wherein the cabin is disposed so that the rider's view is not obstructed in at least one of his positions in the smaller watercraft.

3. The watercraft as defined in claim 2, wherein the cabin is related to the berthing area for operation of the watercraft by a rider either standing or seated in the smaller watercraft without his view being obstructed by the cabin.

4. The watercraft as defined in claim 1, wherein the cabin is disposed at least in part substantially forwardly of the berthing area.

5. The watercraft as defined in claim 4, wherein the bunk is disposed forwardly of the berthing area.

6. The watercraft as defined in claim 5, wherein there are a pair of bunks disposed on opposite sides of the cabin and forwardly of the berthing area.

7. The watercraft as defined in claim 6, further including a hatch for accessing the cabin from the rear.

8. The watercraft as defined in claim 6, wherein the cabin is disposed wholly forwardly of the berthing area.

9. The watercraft as defined in claim 8, further including a hatch for accessing the cabin from the rear.

10. The watercraft as defined in claim 1, wherein the cabin is disposed on at least one side of the berthing area and toward the rear thereof.

11. The watercraft as defined in claim 1, further including a seat disposed in the passenger's area of the main hull and positioned at least in part above the forward portion of the berthing area.

12. The watercraft as defined in claim 11, wherein the seat extends across the upper portion of the berthing area.

13. The watercraft as defined in claim 12, wherein the berthing area defines a recessed portion beneath the seat adapted to engage the bow of the smaller watercraft for preventing vertical movement of the bow.

14. The watercraft as defined in claim 13, wherein the cabin is disposed on at least one side of the berthing area and toward the rear thereof.

15. The watercraft as defined in claim 14, wherein there is a separate cabin provided on each side of the berthing area.

16. The watercraft as defined in claim 15, further including a cover extending across the upper portion of the cabins and berthing area but to the rear of a rider on the smaller watercraft.

17. A watercraft comprised of a main hull devoid of any propulsion device and defining a passenger's area adapted to accommodate a plurality of passengers and a berthing area opening through a transom of said main hull and adapted to accommodate a smaller watercraft hull having a powering internal combustion engine and a propulsion device driven by said engine and in which said engine and propulsion device are capable of propelling said main hull, said smaller watercraft hull having a control for said smaller watercraft and a passenger's area in proximity to said control for control of said smaller watercraft by a passenger in said passenger's area, and means defining a cabin provided on each side of said berthing area containing at least one bunk to accommodate a lying passenger, said cabins being related to said berthing area so that a rider on said smaller watercraft can operate said watercraft when said smaller watercraft is in said berthing area without his view being substantially obstructed by said cabins.

18. The watercraft as defined in claim 17, further including means for affording access to the cabins from the berthing area.

19. The watercraft as defined in claim 17, further including a cover extending across the upper portion of the berthing area but to the rear of a rider on the smaller watercraft.

20. The watercraft as defined in claim 19, further including means for affording access to the cabins from the berthing area.

21. A watercraft comprised of a main hull devoid of any propulsion device and defining a passenger's area adapted to accommodate a plurality of passengers and a berthing area opening through a transom of said hull and adapted to accommodate a smaller watercraft hull having a powering internal combustion engine and a propulsion device driven by said engine and in which said engine and propulsion device are capable of propelling said main hull, said smaller watercraft hull having a control for said smaller watercraft and a passenger's area in proximity to said control for control of said smaller watercraft by a passenger in said passenger's area, and means defining an enclosed cabin in said main hull in at least a portion of said main hull passenger's area forwardly of said berthing area, the height of a top closure of said cabin being lower than the position of the head of a rider on said smaller watercraft when said smaller watercraft is in said berthing area without his view being substantially obstructed by said cabin.

22. The watercraft as defined in claim 21, wherein the passenger's area of the smaller watercraft will accommodate the rider either in standing or seated fashion and operating the control in either fashion and wherein the cabin is disposed so that the rider's view is not obstructed in at least one of his positions in the smaller watercraft.

23. The watercraft as defined in claim 22, wherein the top of the cabin is low enough so that the rider can operate the watercraft from either the standing or seated position in the smaller watercraft without his view being obstructed.

* * * * *